United States Patent [19]

Young

[11] Patent Number: 4,642,036

[45] Date of Patent: Feb. 10, 1987

[54] MAGNET BALL PUMP

[76] Inventor: Niels O. Young, 339 Magnolia, Piedmont, Calif. 94610

[21] Appl. No.: 651,492

[22] Filed: Sep. 17, 1984

[51] Int. Cl.[4] ..... F04D 5/00; F04D 29/22

[52] U.S. Cl. ..... 417/353; 417/420; 415/90; 416/3; 416/179

[58] Field of Search ..... 415/90; 137/561 A; 417/410, 420, 423 R, 353; 418/15; 416/3, 179

[56] References Cited

U.S. PATENT DOCUMENTS

| | | | |
|---|---|---|---|
| 1,263,325 | 4/1918 | Klahn | 415/90 |
| 1,937,525 | 12/1933 | Mobley | 416/179 |
| 3,037,457 | 6/1962 | Sternlight | 415/90 |
| 3,245,665 | 4/1966 | Steel | 416/3 |
| 3,354,833 | 11/1967 | Laing | 417/420 X |
| 3,447,469 | 6/1969 | Laing | 417/420 |
| 3,608,088 | 9/1971 | Dorman et al. | 417/423 R X |
| 3,732,445 | 5/1973 | Laing | 417/420 X |
| 3,923,416 | 12/1975 | Frey | 415/90 X |
| 4,035,108 | 7/1977 | Laing | 417/420 X |
| 4,043,706 | 8/1977 | Walker | 417/353 |
| 4,378,195 | 3/1983 | Gamell | 415/90 X |
| 4,422,822 | 12/1983 | Milleron | 415/90 |
| 4,524,466 | 6/1985 | Hall et al. | 417/389 X |

FOREIGN PATENT DOCUMENTS

| | | | |
|---|---|---|---|
| 884113 | 12/1961 | United Kingdom | 416/3 |

*Primary Examiner*—Carlton R. Croyle
*Assistant Examiner*—Theodore W. Olds
*Attorney, Agent, or Firm*—George W. Dishong

[57] ABSTRACT

A fluid pump including a double-entry impeller whose outer boundary is defined by a dissected spherical surface. The spherical surface includes an equatorial region which may be a groove or a cylindrical surface. The impeller is polarized magnetically and forms a dipole whose axis is normal to the plane of the equatorial region. The rotating magnetic field of a polyphase stator winding spins the impeller, and aligns the impeller spin axis along the stator axis.

15 Claims, 12 Drawing Figures

MAGNET BALL PUMP

BACKGROUND OF THE INVENTION

The present invention generally involves the field of technology pertaining to fluid pumps. More specifically, the invention relates to an improved fluid pump wherein the impeller of the pump is also the rotor of an electric motor so that electromagnetically induced rotation of the impeller upon energization of the motor causes fluid to be pumped between inlet and outlet sides of the pump.

SUMMARY OF THE INVENTION

The invention comprises a highly compact fluid pump which utilizes an impeller of substantially spherical configuration and formed of magnetic material. The impeller is a polarized magnetic solid bounded by an interrupted spherical surface. It is free to spin about any axis within a chamber whose wall is an interrupted spherical surface of slightly larger diameter. Surrounding the impeller is a polyphase stator consisting of soft magnetic material and windings. The center of symmetry of the stator assembly is approximately coincident with the center of symmetry of the impeller. The axis of symmetry of the stator is approximately coincident with the spin axis of the impeller. The magnetic axis of the impeller aligns itself at right angles to the axis of symmetry of the stator by the action of magnetic forces whether or not the stator is electrically energized. When the polyphase stator is energized electrically, its rotating magnetic field captures the impeller and causes it to spin in synchrony. The impeller is provided with an equatorial region therearound, preferably configured in the form of a groove, whereby rotation of the impeller creates a radial outflow between the inlet and outlet of the socket assembly and thereby pumps fluid centrifugally.

The socket assembly is defined by an inlet socket and an outlet socket, each of which is provided with a corresponding recess which collectively define a chamber for supporting the impeller when the sockets are placed in aligned engagement with each other. The input socket functions to receive fluid from the inlet side of the pump and is configured to divide the inlet fluid into two streams of approximately equal mass flow. One stream goes directly to one eye of the impeller, and the other stream is directed to another eye of the impeller by means of a plurality of passageways formed in the sockets. The fluid received by the impeller from the two flow paths is pumped out of the socket assembly through a plurality of passageways formed therein and directed to a confluence at the outlet side of the pump.

This pump, which is designated an "orbic" pump, has a number of advantages over existing pumps. The impeller, which is the orb, normally performs as a double-entry impeller and, therefore, operates at a desirable high specific speed. The orb normally spins without contact, being supported hydrodynamically, and is therefore saved from wear except during starting and stopping of the pump. Wear is further minimized because the orb is free to turn, at random, about its magnetic axis—so as to distribute wear uniformly and in random directions, over the entire spherical surface of the orb.

DETAILED DESCRIPTION OF THE PREFERRED EMBODIMENTS

Figure 1:
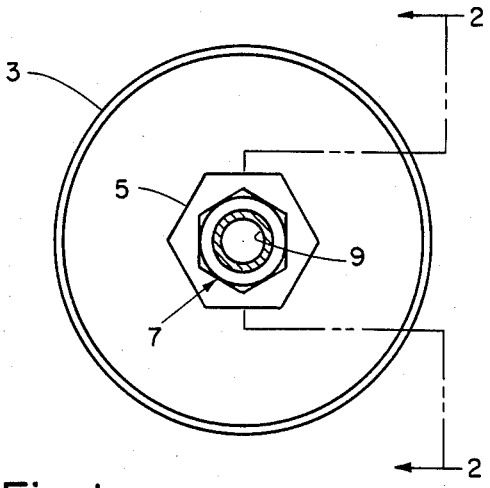
FIG. 1 is a left hand view from the input side of a pump according to a preferred embodiment of the invention.

A pump 1, according to a preferred embodiment of the invention, is shown in FIG. 1 from the fluid input side thereof, and includes a motor housing 3, an end cap 5 and a coupling assembly 7 for connecting a fluid supply line (not shown) to a fluid input line 9.

The details of pump 1 shall now be described with particular reference to FIG. 2. Pump 1 includes a housing section 11 which is centrally disposed through motor housing 3 and extends outwardly from either side thereof to define an input section 13 and an output section 15. Sections 13 and 15 therefore form, respectively, the input and output sides of pump 1. Input section 13 is internally threaded for receiving a threaded stem 17 of cap 5, which is sealed thereto by an appropriate fluid sealing means 19, such as a gasket, O-ring, or the like. Stem 14 is also internally threaded to receive a threaded end 21 of input line 9. A socket retainer 23 is also threadedly engaged within input section 13. Cap 5 and input section 13 are preferably of a corresponding hexagonal transverse cross-sectional configuration.

Housing section 11 is provided with a reduced diameter stepped portion 25 against which a polyphase stator assembly 27 may be disposed within motor housing 3. Stator assembly 27 is also disposed against and around a central section 28 of housing section 11, and is energized through at least three electrical connections, of which only 29 and 31 are shown, from an appropriate source of electricity. three connections of which only 29 and 31 are shown, can, as would be obvious to one skilled in electrical engineering or related fields, be the three terminals required for a delta or wye connected three phase stator, or they can be the three terminals required for a two-phase stator when the phases have a common connection. It is also understood or obvious that some other arrangement of terminals can be used to create a polyphase stator, for example four terminals would be used in the case of a two-phase winding in which the windings are electrically isolated from each other.

The primary purpose of the polyphase stator is to produce a rotating magnetic field which captures the magnet ball and synchronously maintains its spin. The rotating magnetic field due to the presence of drive currents in the stator windings lies in a plane that is normal to the axis of symmetry of the stator. The magnetic field may also be defined as a vector which rotates within an X″-Y″ plane which is fixed to the stator. With this definition the spin axis of the stator magnetic field is therefore along a Z″ axis which is the symmetry axis of the stator. The rotating magnetic field vector can be resolved into components along the X″ and the Y″ axes of the stator. The rotating magnetic field vector has no components in the Z″ direction; although in practice there might be some residual component.

Another purpose of the stator is to align the magnetic poles of the magnet ball so that they tend to lie in a plane normal to the axis of symmetry of the stator. In other words, there is a spring-like restoring force tending to align the magnet ball spin axis Z′ with the stator symmetry axis Z″. This restoring force is the result of magnetic forces between the stator and the magnet ball, and this restoring force exists at all magnet ball spin speeds including zero. Another way to state this purpose of the stator is to say that the polar axis of the magnet ball (the axis connecting its magnetic poles) tends to align itself within the X″, Y″ plane of the stator by magnetic forces.

Figure 2:
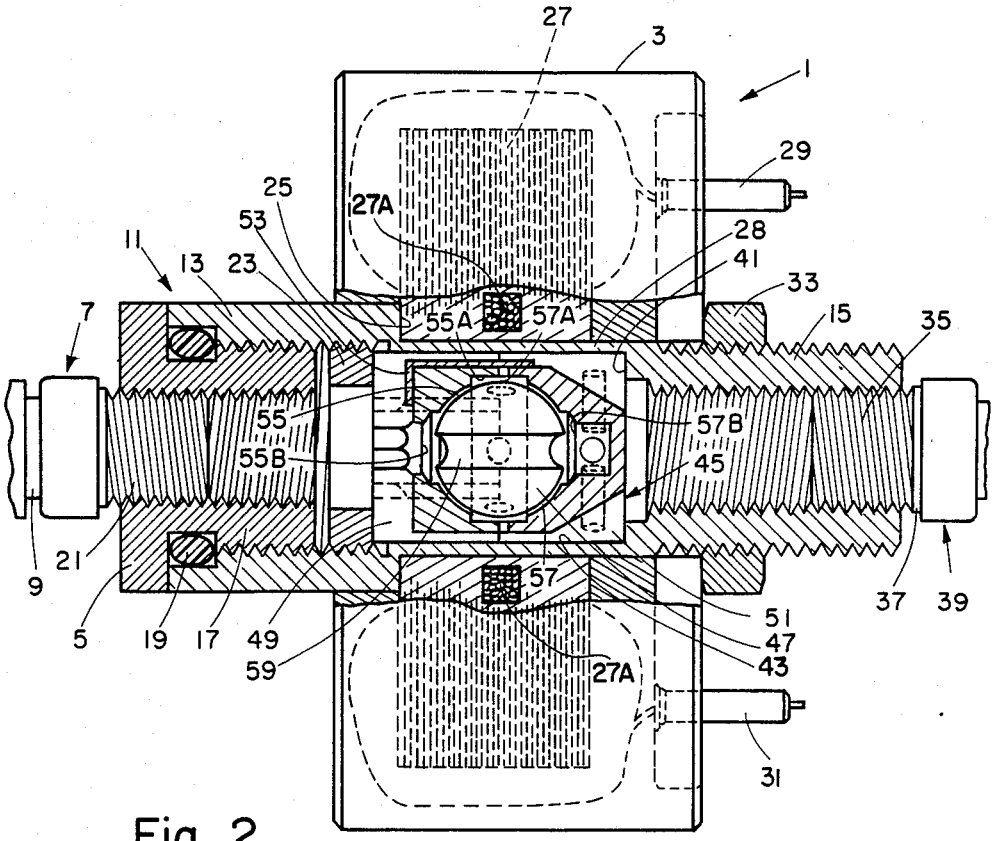
FIG. 2 is an enlarged, fragmentary vertical sectional view, partly in elevation, taken on the staggered section line 2—2 of FIG. 1.
Figure 5:
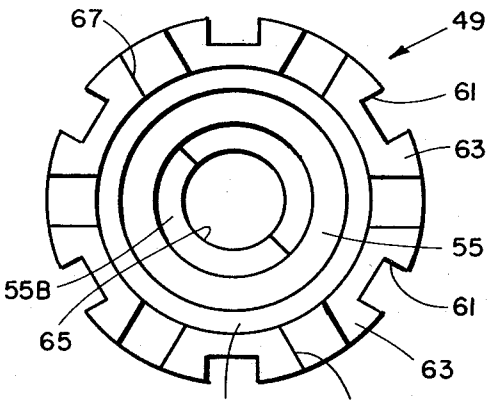
FIG. 5 is an end elevational view as viewed from the right of FIG. 3.
Figure 3:
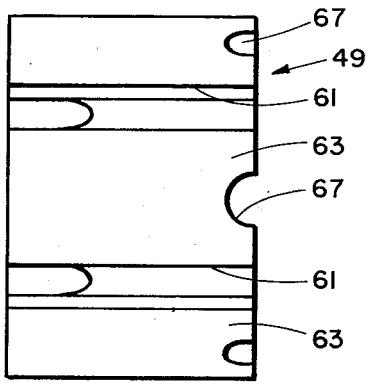
FIG. 3 is a side elevational view of the input socket.

Another purpose of the stator can be realized by means of a solenoidal winding whose axis coincides with the symmetry axis of the stator and which is labelled 27A in FIG. 2. Voltages can be induced in this winding by components of magnetic field in the Z″ direction. The polyphase drive windings of the stator, having field components only in the X″-Y″ plane, induce no voltage in winding 27A. A spinning magnet ball also creates a spinning magnetic field vector and it lies in a plane X′-Y′ that is normal to the orb spin axis Z′. When the magnet ball spin axis Z′ is collinear with the stator symmetry axis Z″, i.e., when the angle Z′ O Z″ is zero, then there is no component of magnetic field in the Z″ direction, and no voltage is induced in the winding 27A. But in general there will be a component of magnetic field along the Z″ axis proportional to the sine of the angle Z′ O Z″. Voltage is induced in winding 27A in direct proportion to small angles (for which the sine of Z′ O Z″ is proportional to the angle itself) of Z′ O Z″. Small angles of Z′ O Z″ are created whenever the stator is slowly rotated in space about its X″ or its Y″ axis, or any combination thereof. The small angle of Z′ O Z″ is the result of the magnet ball spin axis Z′ lagging the motion of the stator axis Z″ through space, as a result of its gyroscopic action. The angle Z′ O Z″ is proportional to the rate of stator rotation about its X″ or Y″ axis in the presence of the restoring forces described in the previous paragraph, and so therefore is the amplitude of the induced voltage in winding 27A. The AC voltage appearing in winding 27A can be synchronously detected with respect to orthogonal components of the stator drive current. The output of the synchronous detectors is then two nearly DC voltages: one proportional to the angular rate of turning of the stator in space about the X″ axis, and the other to the rate of turning about the Y″ axis. Therefore winding 27A enables two-axis rate gyro information to be obtained.

The foregoing discusses how winding 27A is used to obtain rate gyro information by processing voltage induced in winding 27A using electronic means familiar to those practiced in the art. The rate gyro information is in the form of nearly DC voltages which are proportional to the angles X′ O X″ and Y′ O Y″. Winding 27A functions as a sensing winding in this configuration, and its output can be processed electronically to give the direction of the spin axis of the magnet ball.

Winding 27A can also be used as a control winding. By energizing it with AC currents having a desired phase relationship to the stator drive currents the direction of the magnet ball spin axis can be shifted. That is, arbitrary values for the angles X′ O X″ and Y′ O Y″ can be obtained. This capability offered by the winding 27A also means that precessional torques can be applied to the spinning magnet ball. The capability to control the direction of the magnet ball spin axis means that the pump can act as a valve, for when the angle Z′ O Z″ is 90° flow through the pump is blocked. Winding 27A can also be energized with DC current and it will also act to block flow through the pump. In this instance there is no spin and therefore no spin axis; instead the magnet ball tends to alignment with its polar axis parallel to Z″. Normally its polar axis would lie in the X″, Y″ plane due to the passive magnetic restoring forces already mentioned.

To summarize the control options available using the windings of the stator: magnetic forces tending to align the magnet ball polar axis along any of the three orthogonal directions X″, Y″, and Z″ can be created by appropriate currents in the stator windings. The magnet ball can therefore spin about any axis within the X″, Y″, Z″ coordinate system while being driven by a magnetic field vector spinning in a plane normal to that axis.

Output section 15 is externally threaded and provided with a nut 33 for securing housing section 11 to motor housing 3. Output section 15 is also internally threaded and connected to a threaded end 35 of a fluid output line 37, which is in turn connected to a delivery line (not shown) by means of a coupling assembly 39.

The interior of central section 28 is provided with a circumferential stepped portion 41. As is therefore apparent from FIG. 2, portions of the internal surfaces of socket retainer 23, central section 28 and stepped portion 41 collectively define a substantially cylindrical chamber 43 within which is disposed a socket assembly 45 having a corresponding exterior configuration, which socket assembly 45 internally supports a spherical-shaped impeller 47 for free rotation therein.

Socket assembly 45 is defined by an input socket 49 and a corresponding output socket 51, both of which are maintained in aligned engagement with each other, preferably through the use of an alignment key 53, the latter to be later described in detail. Input socket 49 is provided with a substantially hemispherical recess 55 that includes a circumferential flow groove **55*a* and a circular input groove 55*b*. Likewise, output socket 51 is also provided with a corresponding substantially hemispherical recess 57 that includes a circumferential flow groove 57*a* and a circular output groove 57*b*. Recesses 55 and 57 collectively define a substantially spherical chamber within which impeller 47** is supported for free rotation. As is also apparent, circumferential flow grooves 55*a* and 57*a* collectively define a single annular spacing around impeller 47 for permitting fluid flow therethrough. Fluid flow is also permitted around and through spacings defined by circular input groove 55*b* and circular output groove 57*b*.

Impeller 47 is made of polarized magnetic material, preferably samarium-cobalt, Neodymium-iron, platinum-cobalt, or the like, and is supported within socket assembly 45. Impeller 47 is a permanent magnet, and it seeks to align its magnetic axis to lie in a plane normal to the axis of the stator assembly 27. Its magnetic axis is therefore always approximately within this plane whether or not the stator is energized. Magnetic force resulting upon energization of stator assembly 27 causes impeller 47 to rotate about a mechanical axis normal to its axis of magnetic polarization. The mechanical axis is coincident with the spin axis of impeller 47. The mechanical axis is approximately coincident (excepting mechanical tolerances and other minor perturbations) with the axis of symmetry of housing section 11, and also with the axis of symmetry of either or both input and output sockets 49 and 51. As seen in FIG. 2, impeller 47 is essentially orb-shaped, i.e., bounded by a spherical surface that is interrupted by a circumferential groove 59 defined by a recessed equatorial region around impeller 47. Groove 59 is disposed in a plane that is normal to the magnetic polarization axis of impeller 47 so that, when stator winding 27 is energized through electrical connections including 29 and 31, impeller 47 is caused to rotate about an axis normal to its magnetic polarization axis, this axis being a mechanical axis approximately coincident with the axis of symmetry of sockets 49 and 51, as shown in FIG. 2. Groove 59 has several simultaneous functions. It accepts fluid entering the impeller from both sides and therefore defines a pair of opposed impeller eyes. Fluid entering each such eye is divided into two radially outflowing streams, there being four such streams existing concurrently within the boundary of groove 59. Fluid within each of said outflowing streams is slung outward centrifugally by the spin of the impeller and in the fashion of a centrifugal pump impeller. In a region of groove 59 at the greatest radius from the spin axis, the four streams come together in pairs as shown at A in FIG. 10A.

Figure 4:
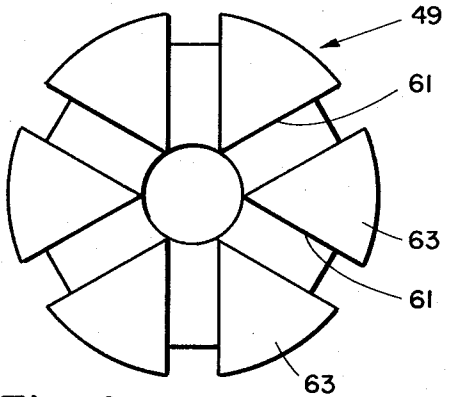
FIG. 4 is an end elevational view as viewed from the left of FIG. 3.

The details of input socket 49 and output socket 51 making up socket assembly 45 shall now be described in detail with reference to FIGS. 3–8. As first seen in FIGS. 3–5, input socket 49 is substantially cylindrical in configuration and provided with a plurality of circumferentially spaced channels 61 that are separated from each other by a plurality of raised land sections 63. Socket 49 is also provided with an inlet opening 65 and, as seen in FIG. 4, channels 61 radiate outwardly from the peripheral edge of opening 65. Each land section 63 is provided with a substantially semicylindrical and radially directed outlet passageway 67.

Figure 8:
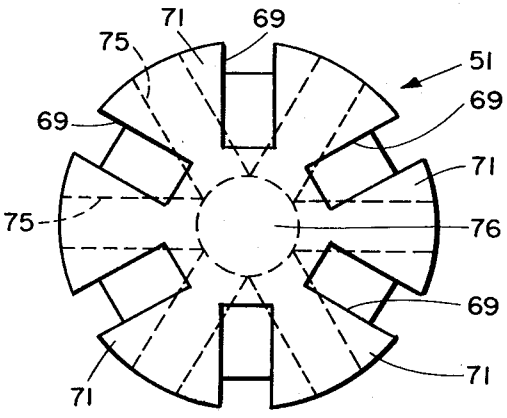
FIG. 8 is an end elevational view as viewed from the right of FIG. 6.
Figure 6:
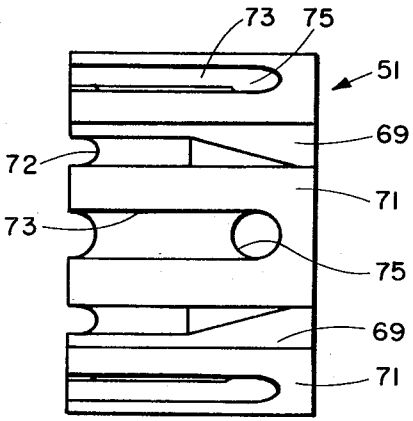
FIG. 6 is a side elevational view of the output socket.
Figure 7:
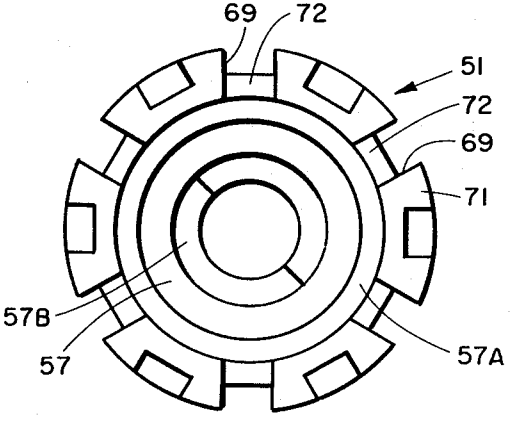
FIG. 7 is an end elevational view as viewed from the left of FIG. 6.

The details of outlet socket 51 shall now be described with reference to FIGS. 6–8. Output socket 51 is also substantially cylindrical in configuration and provided with a plurality of circumferentially spaced channels 69 separated from each other by a plurality of raised land sections 71. Each channel 69 further includes a substantially semicylindrical outlet passageway 72 for alignment with a corresponding outlet passageway 67 to collectively define a cylindrical outlet passageway. Each land section 71 is provided with a channel 73 for alignment with a corresponding channel 61 of input socket 49. Each channel 73 further terminates in a radially directed input passageway 75 for feeding fluid into the interior of socket 51. As more clearly seen in FIG. 8, channels 69 converge radially and terminate at a closed end portion 76 of socket 51.

Figure 9:
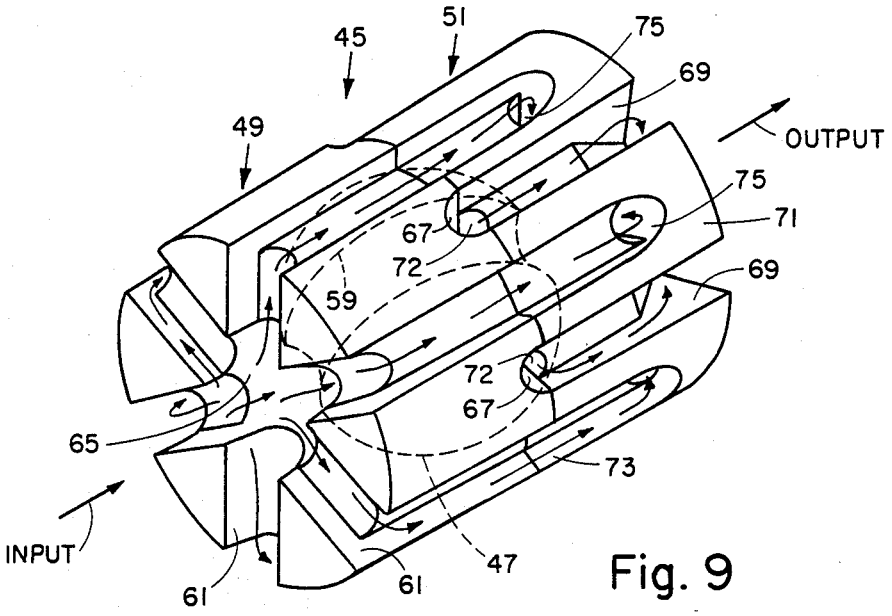
FIG. 9 is an enlarged, isometric view of the input and output sockets in their position of aligned engagement to form the socket assembly, with the spherical-shaped impeller being depicted in dotted lines and disposed within the chamber defined by corresponding recesses provided with the sockets.

With reference to FIG. 9, socket assembly 45 is shown with input socket 49 and output socket 51 in aligned engagement with each other and impeller 47 disposed therein. Fluid directed from the input side of socket assembly 45 is immediately separated into two flow paths, one path being directed linearly into the interior of assembly 45 through opening 65, and the other path being defined by a plurality of subdivided streams flowing radially outwardly along channels 61 and thereafter longitudinally along channels 61 and corresponding aligned channels 73 into input passageways 75. The two flow paths of input fluid are substantially equal and are directed against groove 59 of impeller 47 from opposite sides thereof. The input fluid is thereafter radially directed outwardly through the cylindrical passageways collectively defined by corresponding semicylindrical output passageways 67 and 72, and thereafter along channels 69 to the output side of socket assembly 45. A purpose of socket assembly 45 is to control the feeding and distribution of input fluid flow to rotating impeller 47. The separation of the input flow into two flow paths by input socket 49 and output socket 51 serves to supply each side of the impeller 47 with approximately equal mass flow of fluid; that is, each eye of the double-entry impeller 47 experiences axial or thrust forces which are approximately equal. By means of equalizing these axial forces in this manner, the net thrust load upon the impeller is minimized and so is the drag imposed thereon. Such drag would otherwise tend to retard the spin of the impeller and so reduce the conversion efficiency of the pump. Accordingly, optimum pumping efficiency is realized through the cooperation of rotating impeller 47 and its associated socket assembly 45 in the manner described herein.

Figure 10A:
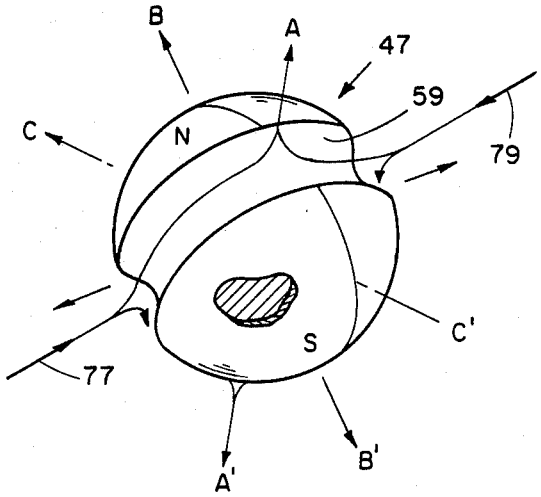
FIG. 10A is an enlarged, isometric view of a preferred embodiment of an impeller utilized in the pump of the invention.

The geometry of the fluid flow paths with respect to impeller 47 shall now be described with reference to FIG. 10A. The main input flow is designated in the direction indicated at 77, which flow is shown to be linearly directed for impact against groove 59 from opening 65 in one flow path, and against groove 59 from the opposite side thereof in the direction indicated at 79 from a second flow path fed from radial streams through passageways 75. By virtue of the rotation imparted to impeller 47, input flow from the two described paths is pumped radially outwardly along four paths: 77 to A, 77 to A′, 79 to A, and 79 to A′. In other words, input flow 77 divides into two equal flows directed toward A and toward A′. At the same time, input flow 79 divides into two equal flows directed toward A and A′. Then output stream A receives flow equally from input 77 and input 79; and mutatis mutandis, output stream A′ receives flow equally from input 77 and input 79. The output steams A and A′ are collected within the grooves 55A and 57A within the corresponding sockets. The output streams decelerate and mix together into one flow, some of their velocity being converted into pressure head. This output flow then escapes from the sockets by means of passageways 67, 72, and 69.

Figure 10B:
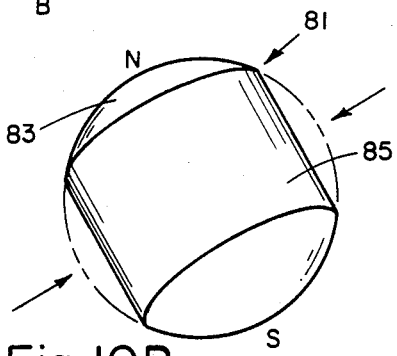
FIG. 10B is an enlarged, isometric view of another embodiment of an impeller which may be utilized in the pump of the invention.

With reference to FIG. 10B, there is shown a second embodiment of an impeller which may be used in the practice of the invention. An impeller 81 is depicted as formed from magnetic material having a substantially spherical outer surface 83 which is interrupted by an equatorial region in the form of a cylindrical surface 85, with the magnetic polarization axis of impeller 81 being coaxial with the longitudinal axis of cylindrical surface 85.

Figure 11:
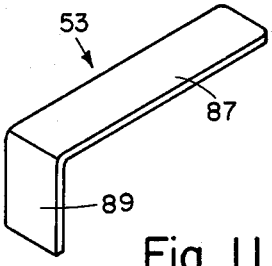
FIG. 11 is an isometric view of a key for securing the input and output sockets in aligned engagement with each other.

As seen in FIG. 11, key 53 used for securing input socket 49 and output socket 51 in aligned engagement with each other is substantially of a flat L-shaped configuration, including a longitudinal leg 87 and a shorter transverse leg 89. In use, sockets 49 and 51 are aligned together as shown in FIG. 9 and longitudinal leg 87 of key 53 is then disposed within and overlaps a pair of corresponding channels 61 and 73. Accordingly, transverse leg 89 is disposed in the corresponding portion of channel 61 adjacent the peripheral edge of opening 65 of socket 49. It is nevertheless understood that any other suitable means well known in the art may be implemented to align sockets 49 and 51 for the practice of the invention as described herein. For example, cooperating means may be provided on both sockets 49 and 51 to effect an automatic keying together thereof into aligned engagement.

The electrical energization of stator winding 27 through connections, of which 29 and 31 are two of three or more utilized, may be realized through an appropriate control circuit system.

The aforedescribed orbic pump is especially well adapted and has been demonstrated to provide pressures between 20 and 150 psi at flows between 0.5 and 15.0 $cm^3 sec^{-1}$. Its performance is enhanced upon using permanent magnetic materials having both a high energy product and a high remanence. It therefore provides an excellent vehicle for evaluating and exploiting the properties of newer magnetic materials, such as samariumcobalt and neodymium-iron.

The pump of the present invention is extremely compact and particularly advantageous for use whenever a small pump structure is desired or required. For example, the invention may be used as a fuel pump or windshield washer pump in automotive and related applications.

While the invention has been described and illustrated with reference to certain preferred embodiments thereof, it shall be appreciated that there are modifications, changes, additions, omissions and substitutions which may be resorted to by those skilled in the art and considered to be within the spirit and scope of the invention and the appended claims.

I claim:

1. A centrifugal flow fluid pump comprising:

(a) a housing section comprising a fluid inlet and a fluid outlet;

(b) an inlet socket disposed within the housing section and provided with a first recess therein;

(c) an outlet socket provided with a second recess therein, the inlet and outlet sockets being disposed to form a socket assembly and configured to provide for fluid communication between the fluid inlet and fluid outlet and wherein the first and second recesses collectively define a chamber, the chamber having a substantially spherical interrupted wall;

(d) a generally spherical impeller comprised of magnetic material having a magnetic polarization axis and disposed within the chamber and sized to be freely disposed within the chamber for rotation on any axis therein whereby the rotation of the impeller creates a radial outflow of a fluid between the fluid inlet and the fluid outlet and the impeller rotates substantially with no contact between the impeller surface and the chamber wall; and (e) an electromagnetic means for rotating the impeller.

2. The pump of claim 1 wherein the impeller includes an equatorial region configured for centrifugal pumping of the fluid.

3. The pump of claim 2 wherein the means for rotating the impeller includes an electrically energizable stator surrounding the socket assembly.

4. The pump of claim 3 wherein the equatorial region is configured in the form of a circumferential groove and the plane of the groove is disposed normal to the magnetic polarization axis of the impeller.

5. The pump of claim 3 wherein the equatorial region is configured in the form of a cylindrical surface and the longitudinal axis of the cylindrical surface is coaxial with the magnetic polarization axis of the impeller.

6. The pump of claim 3 further including means for electrically energizing the stator.

7. A centrifugal flow fluid pump comprising:

(a) a housing section comprising a fluid inlet and a fluid outlet;

(b) an inlet socket disposed within the housing section and provided with a first recess therein, wherein the inlet socket includes a plurality of spaced radially directed inlet passageways and means for dividing the inlet fluid flow into first and second flow paths, the first flow path being linearly directed through the inlet socket towards the impeller, and the second flow path being defined by a plurality of subdivided streams which are directed through the inlet passageways and toward the impeller from a direction opposite to the direction of the first flow path;

(c) an outlet socket provided with a second recess therein, the inlet and outlet sockets being disposed to form a socket assembly and configured to provide for fluid communication between the fluid inlet and fluid outlet and wherein the first and second recesses collectively define a chamber, the chamber having a substantially spherical interrupted wall;

(d) a substantially spherical impeller comprised of magnetic material having a magnetic polarization axis and disposed within the chamber and sized to be freely disposed within the chamber for rotation therein whereby the rotation of the impeller creates a radial outflow of a fluid between the fluid inlet and the fluid outlet and the impeller rotates substantially with no contact between the impeller surface and the chamber wall; and (e) electromagnetic means for rotating the impeller.

8. The pump of claim 7 wherein the inlet and outlet sockets include a plurality of spaced radially directed outlet passageways and rotation of the impeller pumps fluid received from the two flow paths through the outlet passageways and fluid outlet of the housing section.

9. The pump of claim 8 wherein the outlet passageways are each substantially cylindrical in configuration and are defined by aligned semicylindrical passageways formed in the inlet and outlet sockets.

10. The pump of claim 8 wherein the inlet and outlet sockets are provided with a plurality of circumferentially spaced channels and raised land sections which are alignable for defining fluid flow paths.

11. The pump of claim 1 further including means for securing the inlet and outlet sockets together in aligned engagement with each other to form the socket assembly.

12. A centrifugal flow fluid pump comprising:

(a) a housing section comprising a fluid inlet and a fluid outlet;

(b) an inlet socket disposed within the housing section and provided with a first recess therein;

(c) an outlet socket provided with a second recess therein, the inlet and outlet sockets being disposed to form a socket assembly and configured to provide for fluid communication between the fluid inlet and fluid outlet and wherein the first and second recesses collectively define a chamber, the chamber having a substantially spherical interrupted wall;

(d) a substantially spherical impeller comprised of magnetic material having a magnetic polarization axis and disposed within the chamber and sized to be freely disposed within the chamber for rotation therein whereby the rotation of the impeller creates a radial outflow of a fluid between the fluid inlet and the fluid outlet and the impeller rotates substantially with no contact between the impeller surface and the chamber wall wherein the impeller includes two opposed eyes through which fluid enters the impeller from both sides thereof and the sockets form channels for dividing the inlet flow and directing same into each eye of the impeller: and (e) electromagnetic means for rotating the impeller.

13. The pump of claim 1 wherein the electromagnetic rotating means includes a polyphase stator assembly.

14. The pump of claim 13 wherein the polyphase stator assembly controls the direction of the impeller spin axis.

15. The pump of claim 13 wherein the polyphase stator assembly measures electrically the direction of the spin axis.

* * * * *